US010153580B2

(12) United States Patent
Simmonds et al.

(10) Patent No.: US 10,153,580 B2
(45) Date of Patent: Dec. 11, 2018

(54) VOLUME COMPENSATING CONNECTOR PART OF A CONNECTOR UNIT

(71) Applicant: Siemens Aktiengesellschaft, Munich (DE)

(72) Inventors: Mark Simmonds, Ulverston (GB); Antonella Simpson, Barrow-In-Furness (GB); Daniel Walton, Morecambe (GB)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/311,901

(22) PCT Filed: May 7, 2015

(86) PCT No.: PCT/EP2015/060112
§ 371 (c)(1),
(2) Date: Nov. 17, 2016

(87) PCT Pub. No.: WO2015/185321
PCT Pub. Date: Dec. 10, 2015

(65) Prior Publication Data

US 2017/0085023 A1 Mar. 23, 2017

(30) Foreign Application Priority Data

Jun. 4, 2014 (EP) ..... 14171161

(51) Int. Cl.
*H01R 4/60* (2006.01)
*H01R 13/523* (2006.01)
*H01R 13/52* (2006.01)

(52) U.S. Cl.
CPC ..... *H01R 13/523* (2013.01); *H01R 13/5216* (2013.01); *H01R 13/5219* (2013.01)

(58) Field of Classification Search
None
See application file for complete search history.

(56) References Cited

U.S. PATENT DOCUMENTS 3,250,869 A * 5/1966 Link ..... H01H 11/0062 174/11
5,738,535 A 4/1998 Cairns
5,772,457 A * 6/1998 Cairns ..... H01R 13/523 439/201

(Continued)

FOREIGN PATENT DOCUMENTS

GB 1379525 A 1/1975

OTHER PUBLICATIONS

George S. Brady & Henry R. Clauser, 12 TH Edition Materilas Handbook, McGraw-Hill Book Company 1986, pp. 276, 277.*

(Continued)

*Primary Examiner* — Tho D Ta
(74) *Attorney, Agent, or Firm* — Beusse Wolter Sanks & Maire

(57) ABSTRACT

A connector part of a connector unit, wherein the connector unit has a male part and a female part, including at least one volume compensating arrangement with at least a first flexible layer and at least a first chamber. The at least first flexible layer at least partially encases the at least first chamber. The at least one flexible layer includes at least one thermoplastic material.

21 Claims, 8 Drawing Sheets

(56) References Cited

U.S. PATENT DOCUMENTS

| | | | | |
|---|---|---|---|---|
| 6,736,545 | B2 * | 5/2004 | Cairns | G02B 6/3816 174/74 R |
| 7,959,454 | B2 * | 6/2011 | Ramasubramanian | H01R 13/03 439/201 |
| 2014/0024250 | A1 * | 1/2014 | Spencer | H01R 13/523 439/521 |

OTHER PUBLICATIONS

EP Search Report dated Aug. 1, 2014, for EP application No. 14111161.4.
International Search Report dated Aug. 11, 2015, for PCT application No. PCT/EP2015/060112.

* cited by examiner

VOLUME COMPENSATING CONNECTOR PART OF A CONNECTOR UNIT

CROSS REFERENCE TO RELATED APPLICATIONS

This application is the US National Stage of International Application No. PCT/EP2015/060112 filed 7 May 2015, and claims the benefit thereof. The International Application claims the benefit of European Application No. EP14171161 filed 4 Jun. 2014. All of the applications are incorporated by reference herein in their entirety.

FIELD OF INVENTION

The present invention relates to a connector part of a connector unit, wherein the connector unit (12) comprises a male part and a female part, comprising at least one volume compensating arrangement with at least a first flexible layer and at least a first chamber, wherein the at least first flexible layer at least partially encases the at least first chamber.

ART BACKGROUND

In the near future an increasing demands for communication over wide distances, especially for example between continents will be needed. Hence, infrastructures, like sea cables and connectors linking sea cables and modules, e.g. subsea modules, like transformers, pumps etc., that are located and operated error proof subsea will be essential. To isolate the internals and the electrical contacts of the female part of such a connector from salt water and debris as well as to support the mating of the female part with a male part of the connector. A receiving chamber of the female part is filled with an insulation lubricant. During the mate or due to thermal variances a part of the lubricant will be displaced by the male part and will be pushed into a volume compensator. Also, a chamber in which the cable is terminated to the connector, commonly termed the 'gland', is a compensated unit that too will suffer from the effects of expansion due to temperature and pressure variances. It is known to integrate metallic bellows in the connector to compensate for pressure or thermal expansion and contraction. Such a metal bellows must be for example welded to structures of the female part. These welds are often weak points causing sea water to enter the receiving chamber and acting detrimental on connector internals. Moreover, current compensation systems utilise elastomeric diaphragms as a barrier and as a means of pressure and thermal compensation between sea water and connector insulation lubricant (oil, silicone gel etc.). Although elastomeric diaphragms have been seen to be adequate, they are known to permeate sea water over time under extreme circumstances. This can result in failure of the connector.

GB1379525 describes a two part coupling in which one part has a cavity with an end closed by a diaphragm and pin contacts from the other part can penetrate the diaphragm during coupling.

U.S. Pat. No. 5,738,535 describes an underwater electrical or optical connector having a plug unit and a receptacle unit, each having a seal to seal bores in each unit until two parts are mated together.

SUMMARY OF THE INVENTION

It is a first objective of the present invention to provide a connector part for a connector unit that has a reduced risk for water intrusion and thus has a high reliability.

This objective may be solved by a connector part according to the subject-matter of the independent claim.

According to a first aspect of the present invention, a connector part of a connector unit, especially for a use in a subsea application, is provided, wherein the connector unit comprises a male part and a female part, and wherein the connector part further comprises at least one volume compensating arrangement with at least a first flexible layer and at least a first chamber, wherein the at least first flexible layer at least partially encases the at least first chamber.

It is proposed that the at least first flexible layer comprises at least one thermoplastic material.

Due to the inventive matter, the diffusion properties of the volume compensating arrangement are improved by using the thermoplastic material. By lowering the water diffusional permeation the stability of the oils electrical properties over time will improve and hence the reliability of the connectors will also increase. Thermoplastic materials are known to have permeability coefficients >20 times less than that of other materials e.g. elastomers (indeed many hundreds of times lower in many cases). Thermoplastic materials are much less permeable than elastomers. Furthermore, thermoplastic materials have superior corrosion resistance performance when compared with typical metals used in subsea applications. They also outperform metals in their resistance to marine growth.

In addition, due to the lower stiffness of thermoplastic materials, they store less energy (thus exhibiting low spring forces) and hence lower differential pressures across the volume compensating arrangement are realised (i.e. the pressure between the internal and external media are more equally balanced because there is little stored energy within the volume compensating arrangement that must be overcome). Furthermore, thermoplastic materials express excellent fatigue resistance when subject to high cyclic deformations. Such a volume compensating arrangement has better diffusion properties than a traditional elastomeric diaphragm and further can be realised in a more compact, space efficient assembly than a comparable metal bellows or piston type design could achieve.

Thus, a flexible, space efficient volumetric, pressure and/or temperature volume compensating arrangement can be provided that can be advantageously used in subsea applications such as wet mateable connectors or penetrators.

Even if the terms "volume compensating arrangement, flexible layer, chamber, material, surface, coating, diaphragm, bellows, section, security volume, receiving chamber and wall" (see also below) are used in the singular or in a specific numeral form in the claims and the specification the scope of the patent (application) should not be restricted to the singular or the specific numeral form. It should also lie in the scope of the invention to have more than one or a plurality of the above mentioned structure(s).

A connector unit is intended to mean a unit which physically connects at least two parts, like two cables, in particular subsea cables, or a cable with a—subsea—module (e.g. a transformer, a pump etc.) or a busbar inside of the module or two modules, respectively. Thus, it is advantageously a subsea connector unit. The connector unit may be used in any harsh environment and may be embodied as an electrical connector and/or penetrator or advantageously as a wet mateable connector/penetrator. Moreover, it is advantageously employed in a high voltage application.

Such a connector unit comprises at least a conductor part that helps to establish an electrical connection in a mated position of two connected parts, like two cables or a cable with a module. This conductor part may be a conductor pin, receptacle pin or male part of a connector or of a penetrator or a socket contact of a female part, plug or socket or connector body of a connector for contacting a conductor pin of a male part. Thus, the inventive connector part is embodied as the male part and/or as the female part and especially, as the female part of the connector unit. The connector part may also be a cable termination.

Furthermore, the female socket is intended to mean a part of the connector unit with an opening, recess bore or receiving chamber to receive another part of the connector unit, like the conductor pin or parts thereof. Moreover, in case of an embodiment of the connector unit as comprising a penetrator the conductor pin is permanently connected to a cable or a module via a housing. Thus, the conductor pin is intended to mean a part of the unit with a pin, extension or the like to engage or being inserted in the receiving chamber of the female socket or the cable or the module. The conductor pin and its corresponding part (female socket, cable or module) are intended to establish an electrical connection either in case of mating of the male and female parts or a permanent connection of the conductor pin with the cable or module. The female and male parts or the module each may be encased in a casing or an external of a cable.

A volume compensating arrangement is intended to mean a device, structure or system embodied to compensate changes in a volume of a lubricant (oil, silicone gel, grease etc.) for example due to pressure or thermal expansion or contraction. Such a volume compensating arrangement may be arranged or integrated in any area of the connector unit or part where compensation is required. Advantageously, the volume compensating arrangement is arranged in the female part. A flexible layer, also referred to as layer in the following text, is intended to mean a layer that is able to adjust its shape due to an external stimulus like a volume change. The flexible layer is embodied in such a way to allow an adjustment of a volume of the chamber especially caused by pressure and temperature variances or expansion and contraction.

A chamber should be understood as a compensation chamber and/or as a flexible cavity that is either completely encased by flexible walls or advantageously a cavity that is basically encased by flexible walls and in flow communication with another chamber, advantageously a receiving chamber, especially of the female part. In other words, the chamber is adapted to receive and/or to take up the lubricant. Advantageously, the receiving chamber houses the lubricant. In this context "basically encased" should be understood as that the cavity has at least one opening or that at least 70% of the cavity are encased by flexible walls, advantageously at least 85% of the cavity are encased by flexible walls and most advantageously at least 95% of the cavity are encased by flexible walls.

The phrase "partially encase" should be understood that the flexible layer is a part of a wall or walls surrounding the chamber and that it represents at least 10% of the wall(s) encasing the chamber, advantageously at least 25% and most advantageously at least 40%.

The thermoplastic material may be any material feasible for a person skilled in the art. Advantageously, the thermoplastic material is a Polytetrafluoroethylene (PTFE)-based material and most advantageously Polychlorotrifluoroethylene (PCTFE). Hence, materials with known and well proven properties like permeability, flexibility and stability, can be used. It is also possible to use a combination of two or more thermoplastic materials.

Furthermore, it is provided that the at least first flexible layer has a thickness of about 0.2 millimeter (mm) to 2 mm, advantageously of about 0.5 mm to 1.5 mm and most advantageously of about 0.75 mm to 1.25 mm. With such a thickness of the flexible layer the volume compensating arrangement is compact and space saving.

Moreover, the at least first flexible layer comprises at least one coating. Since such a coating may exhibit extremely good diffusion properties the overall diffusion properties of the volume compensating arrangement can be further enhanced especially compared with the sole thermoplastic layer. Moreover, the coating may increase the stability of the flexible layer. The possibility to coat a thermoplastic layer is an additional advantage of using a thermoplastic e.g. instead of an elastomer. This is possible due to the very low elongation properties of the thermoplastic materials. In other words, the thermoplastic material is subject to negligible amounts of mechanical elongation or it will not stretch in the application of a subsea compensation system.

In an embodiment a surface of the at least first flexible layer that faces the at least first chamber comprises at least one coating. Arranging the coating to the inside of the chamber beneficially protects the coating from detrimental effects, like marine growth or corrosion. The surface is an internal surface or side of the cavity/chamber, i.e. a non-sea water wetted surface.

Advantageously, the coating has a thickness of about 0.2 micrometer (μm) to 2 μm, advantageously of about 0.5 μm to 1.5 μm and most advantageously of about 0.75 μm to 1.25 μm. Due to this, a good balance between enhanced permeability as well as stability and flexibility can be achieved.

Advantageously, the at least one coating comprises at least one corrosion resistant material protecting the coating and thus the flexible layer from damage. According to a a realisation of the invention the at least one coating comprises at least one (corrosive resistant) metal. By using a metal the stability of the flexible layer may be enhanced. Further, the adoption of a metal coating gives the very low water permeability required of such a subsea volume compensating arrangement and therefore allows the thickness of the thermoplastic substrate to be reduced. Using a low permeation metal coating allows for various thermoplastic materials with relatively thin sections to be used. This increases the flexibility of the layer. All this in turn leads to a more compact, extremely space-efficient, flexible volume compensating arrangement design.

The metal may be any metal, alloy or any combination thereof that is feasible for a person skilled in the art. Furthermore, a metal may for example be out of copper, a copper alloy, aluminium, nickel-cobalt ferrous alloy (e.g. Kovar®), molybdenum, titanium and (phosphorous) nickel. Advantageously, the metal is titanium.

The coating may be easily obtained when the coating is applied by one of the following methods: Physical vapour deposition (PVD), coating, high velocity oxygen fuel spraying (HVOF) and plasma spraying. Advantageous is the applying by physical vapour deposition (PVD).

According to a realisation of the invention the at least first flexible layer is embodied as a thermoplastic toroidal diaphragm providing a device that is easy to mount as well as adapted to a circular shape of the connector part and the receiving chamber. This arrangement allows for the diaphragm to compensate axially as oppose to diametrically, reducing the length of the compensation chamber. A diaphragm should be also understood as membrane. The flexible layer is advantageously a metalized thermoplastic diaphragm.

In an alternative embodiment of the invention the at least first flexible layer is embodied as a flexible bellows or as a cylindrical diaphragm. As a result a connector part with a compact design and a narrow radial extension can be provided. Moreover, the compensation chamber has a good intake capacity allowing for not just temperature and pressure compensation, but displacement of lubricant due to the introduction of a male part or male pin. The flexible layer is advantageously a metalized thermoplastic bellow.

According to a further alternative embodiment the at least first flexible layer comprises at least two axially compressible sections arranged in axial direction of the connector part one after the other. This allows a volume compensating arrangement with a shorter axial length than the embodiment with the straight walled bellows. The flexible layer is advantageously folded like an accordion.

In an advantageously embodiment of the invention the at least first flexible layer is arranged basically perpendicular to an axis of the connector part. Hence, the volume compensating arrangement has a short axial length reducing the axial size of the connector part. Advantageously, the at least one flexible layer is embodied as a toroidal diaphragm that is arranged in circumferential direction around an axis of the connector part and/or around the receiving chamber. This provides a compact arrangement in the connector part.

According to an alternative embodiment and/or an additional feature of the invention the at least first flexible layer is arranged basically in parallel to an axis of the connector part. This allows the integration of the volume compensation arrangement in a radially narrow connector part.

It is further provided, that the volume compensating arrangement comprises at least a second flexible layer giving the volume compensating arrangement a second movement (expansion/contraction) direction. Advantageously, the at least second flexible layer partially encases the at least first chamber. This reduces a radial width of the volume compensating arrangement or the chamber, respectively, in comparison to a construction with a single flexible layer.

According to a further aspect of the present invention the volume compensating arrangement comprises at least one security volume that is arranged directly adjacent to the at least first flexible layer of the at least first chamber in a direction basically coaxially to an axis of the connector part. Thus, the volume compensating arrangement is protected in case of an accidental damage or rupture of the flexible layer. The security volume is for example embodied by a chamber partially encased by the first flexible layer and a further flexible layer. In other words, the first flexible layer is a barrier between the first chamber and the security volume. This further layer is arranged basically in parallel to the first flexible layer. The term "basically coaxial" should be understood as an arrangement of the security volume in respect to the axis with a deviation of up to 30% from the strict coaxial arrangement.

The security volume is advantageously filled with a fluid, like oil. Moreover, the security volume has basically a constant volume, meaning that the liquid inside the security volume is basically unaffected by the pressure and thermal expansion or contraction of the first chamber. In this context "basically unaffected" should be understood as that slight changes (±2.5%) in the volume may occur and would still be viewed as constant. Due to this, the security volume will passively follow the change of shape of the first chamber.

Advantageously, the volume compensating arrangement comprises at least two security volumes enhancing the level of security. It is further provided that at each axial side of the at least first chamber at least one security volume is arranged securing the first chamber at both sides where the extension/deformation will occur. In other words, the two security volumes flank the first chamber on both axial sides.

In case of a construction of the volume compensating arrangement with two security volumes it comprises four flexible layers arranged all in radial direction. The two middle flexible layers together encasing the first chamber and one middle flexible layer together with one axially outer flexible layer encase one security volume.

In a further advantageous realisation of the invention at least two volume compensating arrangements are provided to increase the overall capacity of the compensation action. Moreover, with two or even more volume compensating arrangements a radial width of the connector part can be further reduces in comparison to a construction with only one volume compensating arrangement. A number of volume compensating arrangements will be a balance between the needed compensation volume as well as the axial length and radial width of the connector part and will be selected from a person skilled in the art due to his knowledge in the field.

As described above the connector part comprises at least a receiving chamber. Advantageously, the at least two volume compensating arrangements are connected—especially in axial direction—in parallel to the receiving chamber. Thus, each volume compensating arrangement works independently from the other. Thus, malfunctions will be restricted to the damaged volume compensating arrangement.

Moreover, the volume compensating arrangement comprises at least one sealing member ensuring the secure operation of the volume compensating arrangement. The sealing member may be any means, device or structure suitable for a person in the art, like a clamping mechanism, an adhesive bond and/or a form or force fit connection.

Advantageously, the sealing member is formed integrally with the flexible layer. This is so, because due to the material properties of the thermoplastic material, especially of a 'soft' thermoplastic, such as a PTFE-based material, extra sealing features or seals can be omitted, because ends of the flexible layer, especially in case of a toroidal diaphragm, can be clamped between at least two surfaces of a casing of the volume compensating arrangement, acting as a seal. Hence, the flexible layer has flexible properties as well as sealing properties. This reduces space, pieces, mounting affords and costs.

As stated above the connector part comprises at least a receiving chamber. In a further realisation of the invention the at least first flexible layer and a wall of the receiving chamber at least partially encase the first chamber. Thus, a robust interaction surface for the lubricant can be provided.

As described above, the at least first flexible layer may comprise at least two compressible sections. In a further realisation of the invention one compressible section and a wall of the receiving chamber at least partially encase the first chamber and the other compressible section and a wall of the receiving chamber at least partially encase an at least second chamber of the volume compensating arrangement. Due to this, one chamber (the first chamber) can expand or be compressed in radial direction independently of a radial expansion or compression of the second chamber. Only an axial change in volume of the first chamber is transferred to the second chamber. The two chambers are arranged in axial direction one after the other. Moreover, to allow a displacement of lubricant housed in the second chamber due to the compression of the second section caused by the axial extension of the first chamber the first and the second chamber are in fluid communication with each other.

In a further embodiment of the invention the at least first flexible layer is manufactured by one of the following methods: machined from a homogenous stock material or a moulding process. Due to this, the flexible layer is a one piece part or may have a single component design, especially when embodied as a toroidal diaphragm or as a bellow. In other words, the flexible layer may be formed from a single component. Hence, the flexible layer is advantageously, created as a homogenous part. Unlike some comparable methods, such as metal bellows, no welding or additional fabrication methods are required. Welds are seen as a point for the onset of corrosion and an area where fatigue resistance can be compromised.

Advantageously, the inventive connector part is embodied as the male part and/or as the female part and especially, as the female part of the connector unit. Due to this a reliable mating of the male and female part can be provided.

The above-described characteristics, features and advantages of this invention and the manner in which they are achieved are clear and clearly understood in connection with the following description of exemplary embodiments which are explained in connection with the drawings.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
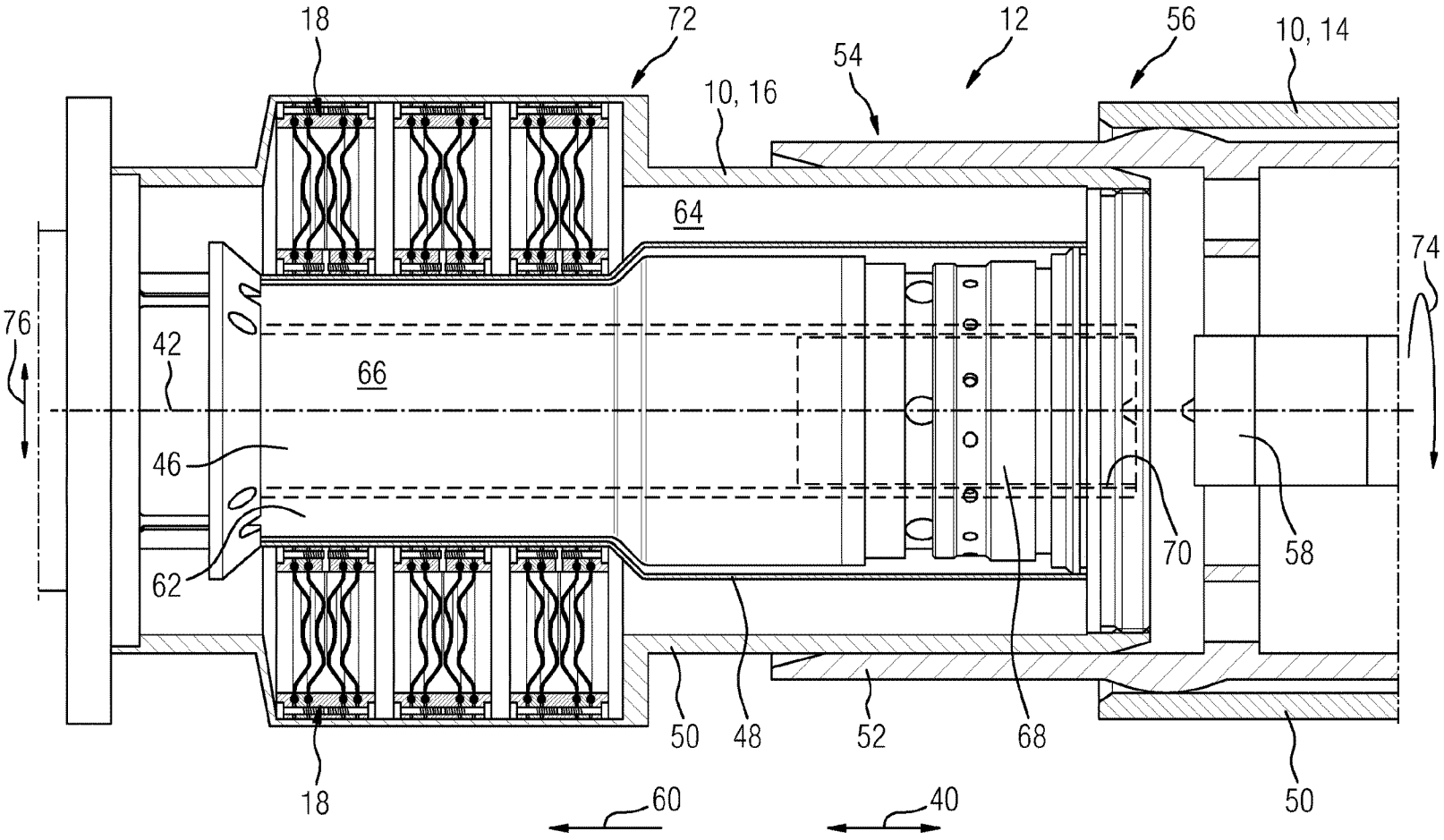
FIG. 1: shows schematically a cross section through a subsea connector unit with an conductor pin and a female socket with three volume compensating arrangements beforehand of mating.

The illustrations in the drawings are schematically. It is noted that in different figures, similar or identical elements are provided with the same reference signs.

FIG. 1 shows an high voltage subsea connector unit 12 for connecting two connected parts, like two subsea cables (not shown), wherein the connector unit 12 comprises two inventive connector parts 10 in the form of a male part 14 or a conductor pin 14 and a female part 16 or female socket 16. Both the conductor pin 14 and the female socket 16 are each encased in a housing 50 which will be axially aligned with help of a connecting aid 52 during a mating or demating process of the male part 14 and female part 16. The female socket 16 is located at a plug front end 54 of one subsea cable and comprises an axially extending receiving chamber 46 with not in detail shown seals for preventing entering of water and dirt into internals of the female part 16. The male part 14 is located at a receptacle front end 56 of the other subsea cable and comprises a receptacle pin assembly 58.

For a mating of the male part 14 and female part 16 the receiving chamber 46 and the receptacle pin assembly 58 will be arranged axially aligned towards each other, so that by moving the receptacle pin assembly 58 in direction of the female part 16 or the moving direction 60, the receptacle pin assembly 58 can partially enter the receiving chamber 46 of the female part 16. Due to a proper positioning of the receptacle pin assembly 58 in the receiving chamber 46 of the female part 16 an electrical connection is established between the male part 14 and a socket contact 62 of the female part 16.

Figure 2:
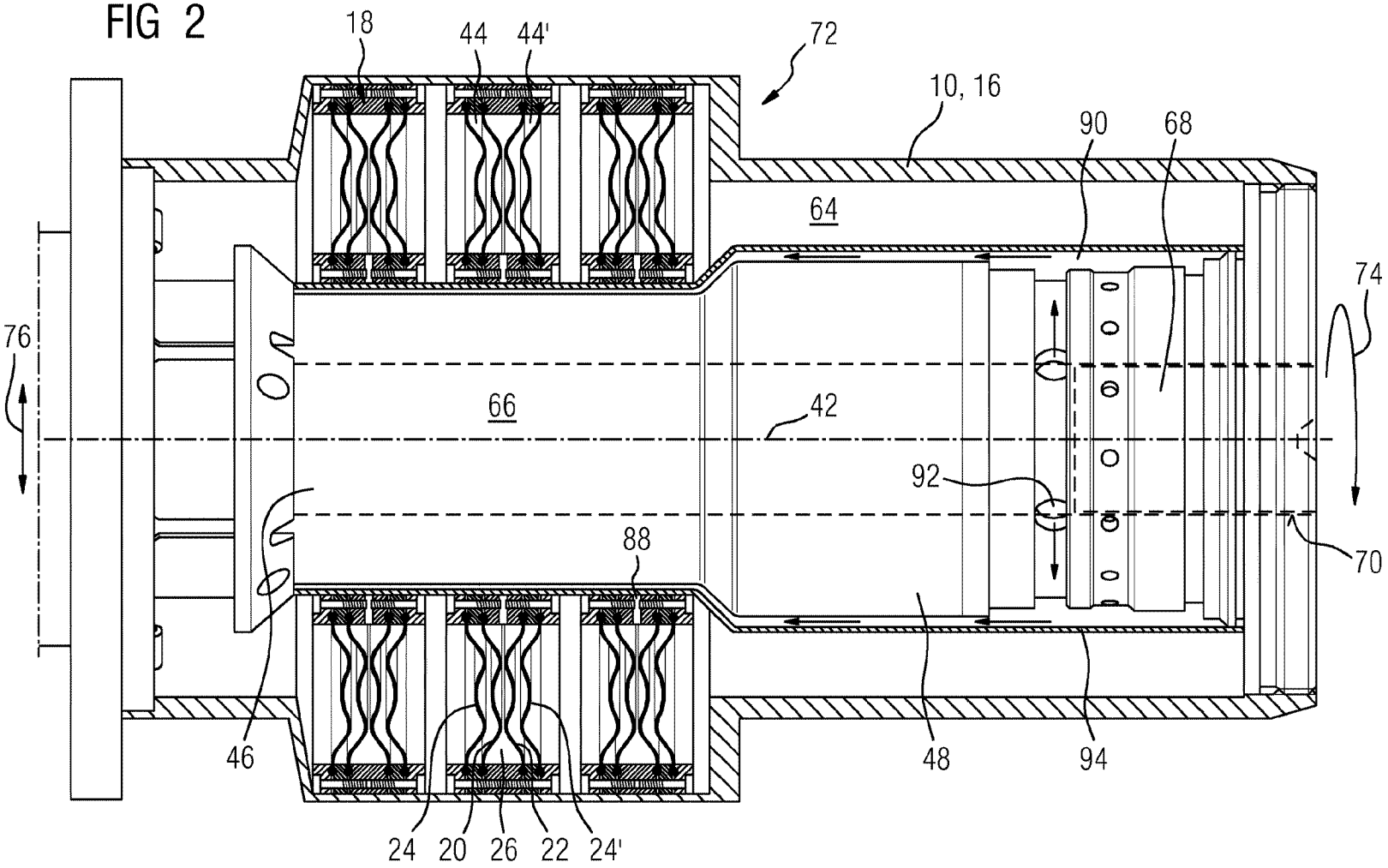
FIG. 2: shows schematically the female socket with the three volume compensating arrangements from FIG. 1 in an unmated position.
Figure 3:
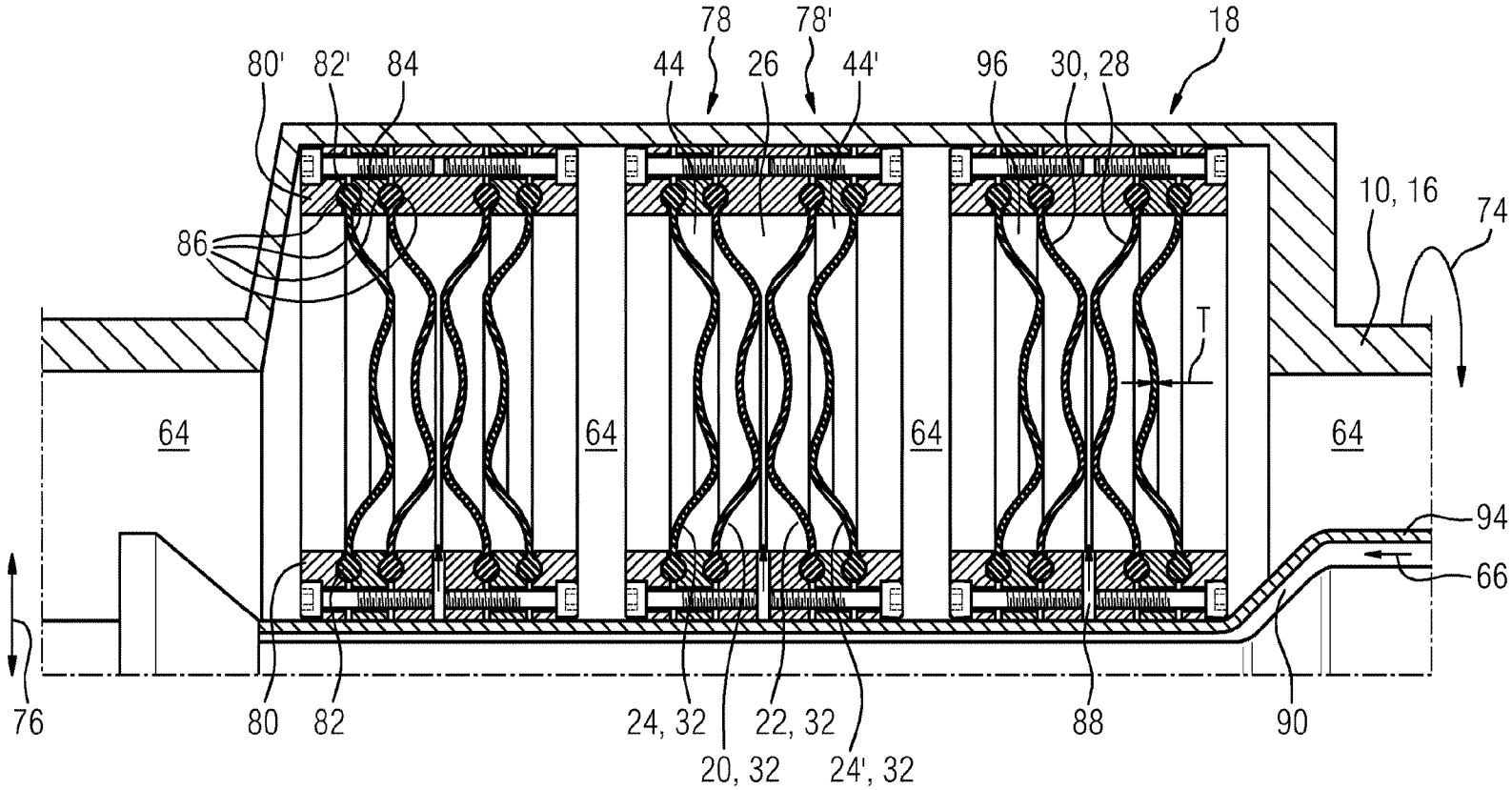
FIG. 3: shows an enhanced view of the three volume compensating arrangements of FIG. 2, FIG. 4: shows the connector unit after the mate with the three volume compensating arrangements of FIG. 3 in their extended state.

To isolate the internals from the surrounding sea water, that can enter a section 64 of the female part 16, and to prevent sea water and debris to enter the receiving chamber 46 the receiving chamber 46 is filled with a lubricant 66 (like isolating oil) which is closed and sealed on the front by a shuttle pin 68 contained within the female part 16. The shuttle pin 68 is pushed back as the male pin 14 is introduced, but a seal is maintained as they have equal diameters. Due to a pushing force of the male part 14 during the mate the lubricant 66 is displaced from the receiving chamber 46 into three volume compensating arrangements 18 of the female part 16 (details see below). These volume compensating arrangements 18 compensate pressure as well as thermal expansion and contraction of the lubricant 66. The volume compensating arrangements 18 are shown in FIG. 2 as well as in an enhanced view in FIG. 3, which show the female part 16 in the unmated state.

The volume compensating arrangements 18 are arranged in a rear part 72 of the female socket 16 and they are connected in axial direction 40 in parallel to the receiving chamber 46 of the female part 16. Each volume compensating arrangement 18 is embodied as a toroidal ring structure being arranged coaxially to an axis 42 if the connector part 10 in a circumferential direction 74 around the socket contact 62. Further, each volume compensating arrangement 18 comprises four flexible layers 20, 22, 24, 24' or a first flexible layer 20, a second flexible layer 22 and two further (third) flexible layers 24, 24' and a first chamber 26.

All flexible layers 20, 22, 24, 24' are arranged basically perpendicular to the axis 42 of the connector part 10 or in radial direction 76 and are embodied as a thermoplastic toroidal diaphragms 32 each (details see below). Moreover, the first flexible layer 20 and the second flexible layer 22 encase the first chamber 26 at two opposed axial sides 78, 78'. The first chamber 26 is further encased by a radially inner and a radially outer wall 80, 80' of the volume compensating arrangement 18. Radial ends 82, 82' of the flexible layers 20, 22, 24, 24' are clamped between wall segments 84 of the walls 80, 80' to build integral seals 86 for the first chamber 26 and adjacent security volumes 44, 44' (see below).

The radially inner wall 80 comprises a central aperture 88 to allow the lubricant 66 to enter the first chamber 26 from a supply channel 90 connecting the receiving chamber 46 via holes 92 with each volume compensating arrangement 18 (see below). To hinder the lubricant 66 to exit the supply channel 90 not shown seals are provided radially between the inner wall 80' of the volume compensating arrangement 18 and a metal sleeve 94 surrounding the supply channel and a wall 48 of the receiving chamber 46.

Moreover, the volume compensating arrangement 18 comprises two security volumes 44, 44' that are arranged directly adjacent to the first flexible layer 20 and second flexible layer 22 of the first chamber 26 in a direction basically coaxially to the axis 42 of the connector part 10. In other words, one security volume 44 is arranged axially beside the first flexible layer 20 or at side 78 and the second security volume 44' is arranged axially beside the second flexible layer 22 or side 78'. Each security volume 44, 44' is axially restricted by one of the further flexible layers 24, 24'. Hence, one security volume 44 is encased by the first flexible layer 20 and one of the further flexible layers 24 and the other security volume 44' is encased by the second flexible layer 22 and the other further flexible layer 24'. The security volumes 44, 44' are further encased by the inner and the outer walls 80, 80' and their inner cavity 96 is filled with a fluid, for example the lubricant 66.

All flexible layers 20, 22, 24, 24' comprise at least one thermoplastic material or is manufactured out of a thermoplastic material, respectively. This thermoplastic material is advantageously a Polytetrafluoroethylene (PTFE)-based material and most advantageously Polychlorotrifluoroethylene (PCTFE). Furthermore, all flexible layers 20, 22, 24, 24' are manufactured by one of the following methods: machined from a homogenous stock material or a moulding process. Each flexible layer 20, 22, 24, 24' has a thickness T of about 0.2 millimeter (mm) to 2 mm, advantageously of about 0.5 mm to 1.5 mm and most advantageously of about 0.75 mm to 1.25 mm.

To stabilise the flexible layers 20, 22, 24, 24' and to lessen their permeability a surface 28 of the flexible layer 20, 22, 24, 24' that faces the first chamber 26 or the cavity 96 of the security volume 44, 44' comprises a coating 30 out of a corrosion resistant material and especially out of the metal titanium. The coating 30 has a thickness T of about 0.2 micrometer (μmm) to 2 μm, advantageously of about 0.5 μm to 1.5 μm and most advantageously of about 0.75 μm to 1.25 μm (not shown) and is applied by physical vapour deposition (PVD).

Figure 4:
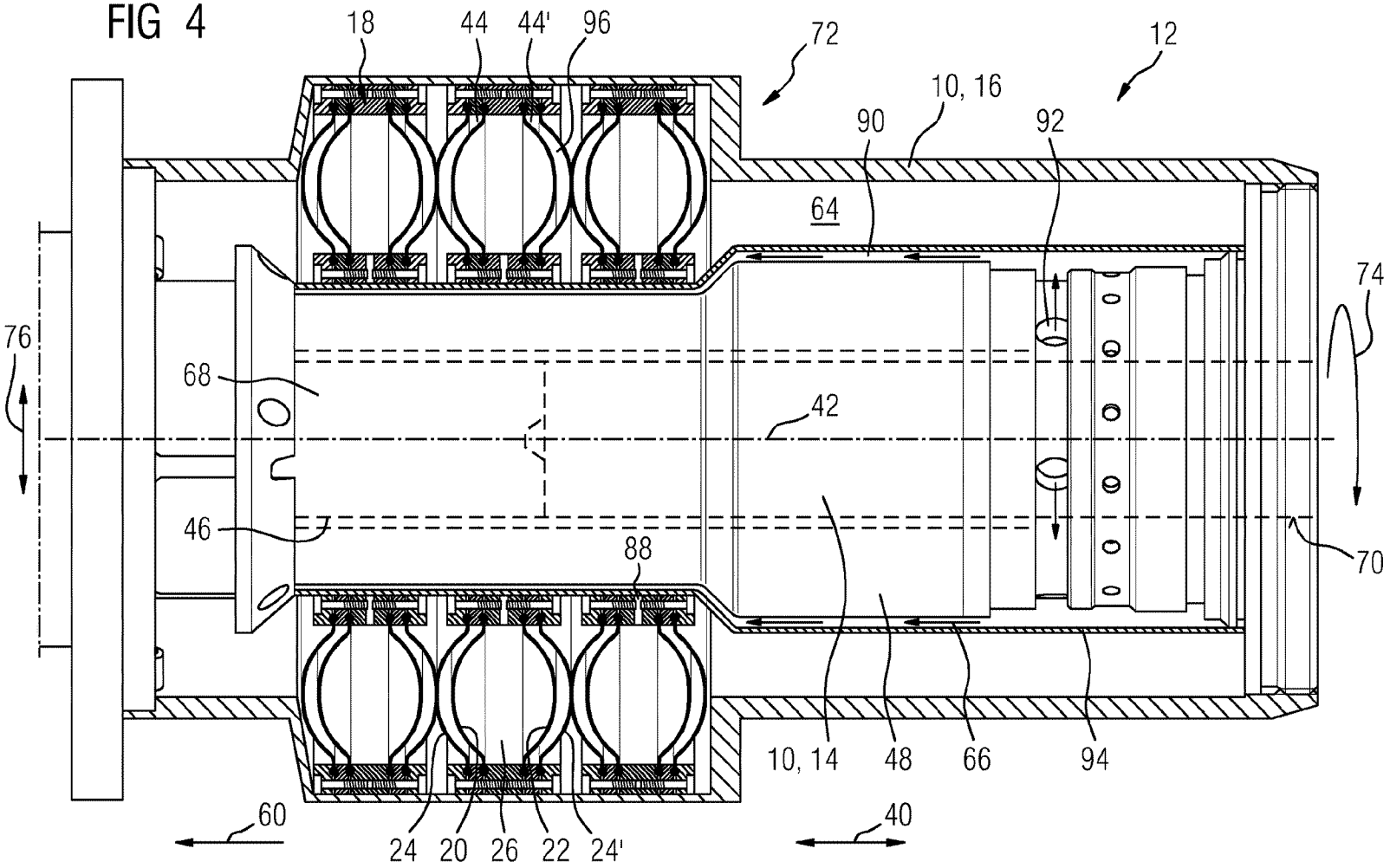

During the mate the male pin 14 pushes the shuttle pin 68 of the female part 14 further into the receiving chamber 46. Due to this the lubricant 66 in the receiving chamber 46 is forced to exit the receiving chamber 46 through the holes 92. There the lubricant 66 is free to flow around the metal sleeve 94 or along supply channel 90 and through aperture 88 into the first chamber 26 of the volume compensating arrangement 18. Because of the flexibility of the flexible first and second layers 20, 22 the first chamber 26 expands. The expansion is either limited by the capacity of the first chamber 26 and/or by the positioning of the shuttle pin 68 and the male pin 14 in the fully mated position. The security volume 44, 44' has a fixed volume and thus only passively expands with the first chamber 26. The fully mated state is shown in FIG. 4.

As the male pin 14 is removed from the receiving chamber 46 and the shuttle pin 68 returns to its unmated position, the lubricant 66 is free to flow back via the supply channel 90 and the holes 92 into the receiving chamber 46.

In FIGS. 5 to 8 an alternative exemplary embodiment of the volume compensating arrangement 18 is shown. Identical components, features and functions are denoted by the same reference numerals. However, to distinguish the exemplary embodiment of FIGS. 5 to 8 over that of FIGS. 1 to 4 the letter 'a' was added to the reference numerals of the components that are designed differently in the exemplary embodiments of FIGS. 5 to 8. The description below is substantially limited to these differences compared to the exemplary embodiment of FIGS. 1 to 4, wherein reference is made to the description of the exemplary embodiment in FIGS. 1 to 4 with respect to identical components, features, and functions.

Figure 5:
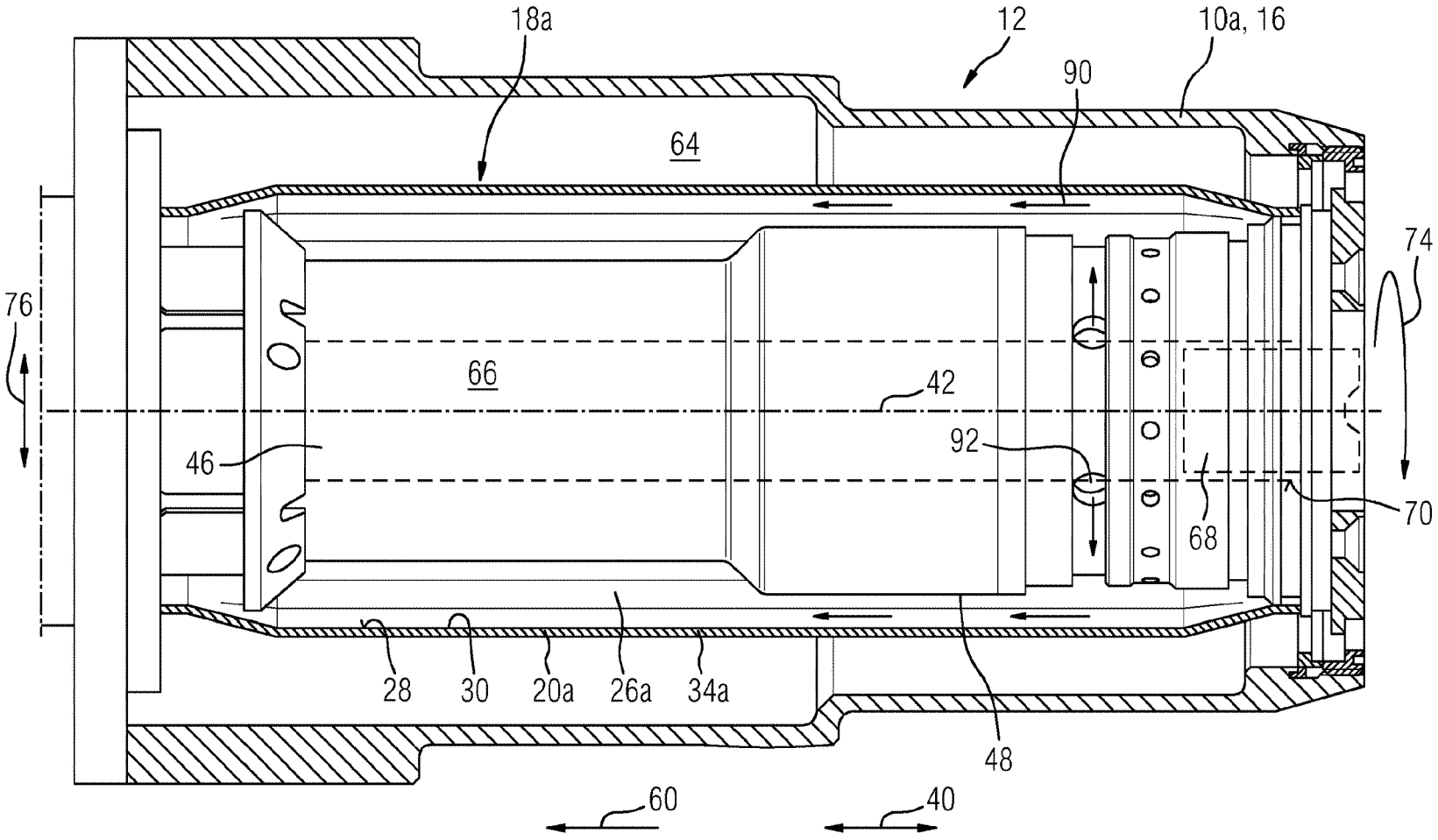
FIG. 5 shows schematically a female socket with an alternatively embodied volume compensating arrangement in an unmated position.
Figure 6:
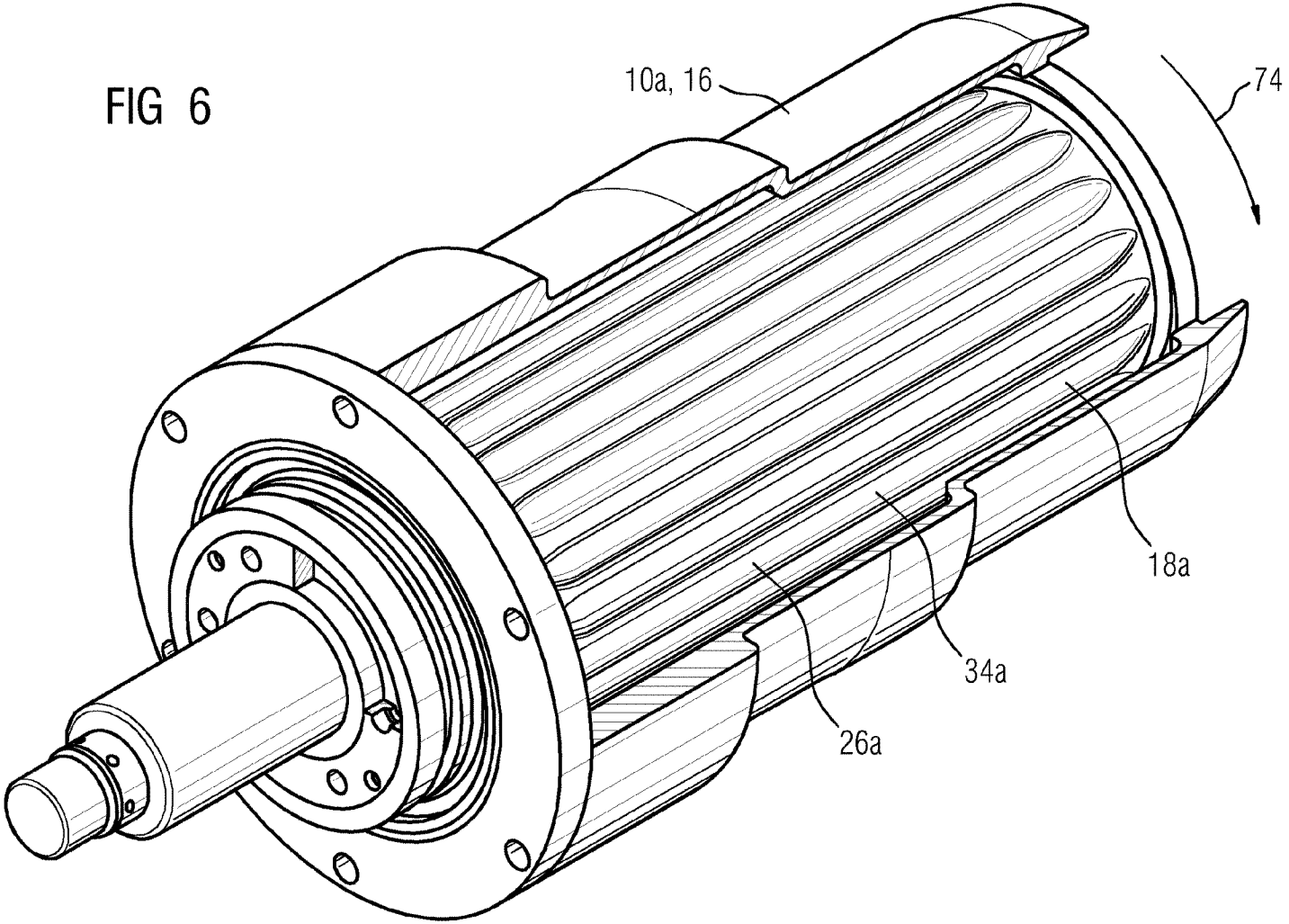
FIG. 6 shows a perspective view of the female socket from FIG. 5.
Figure 7:
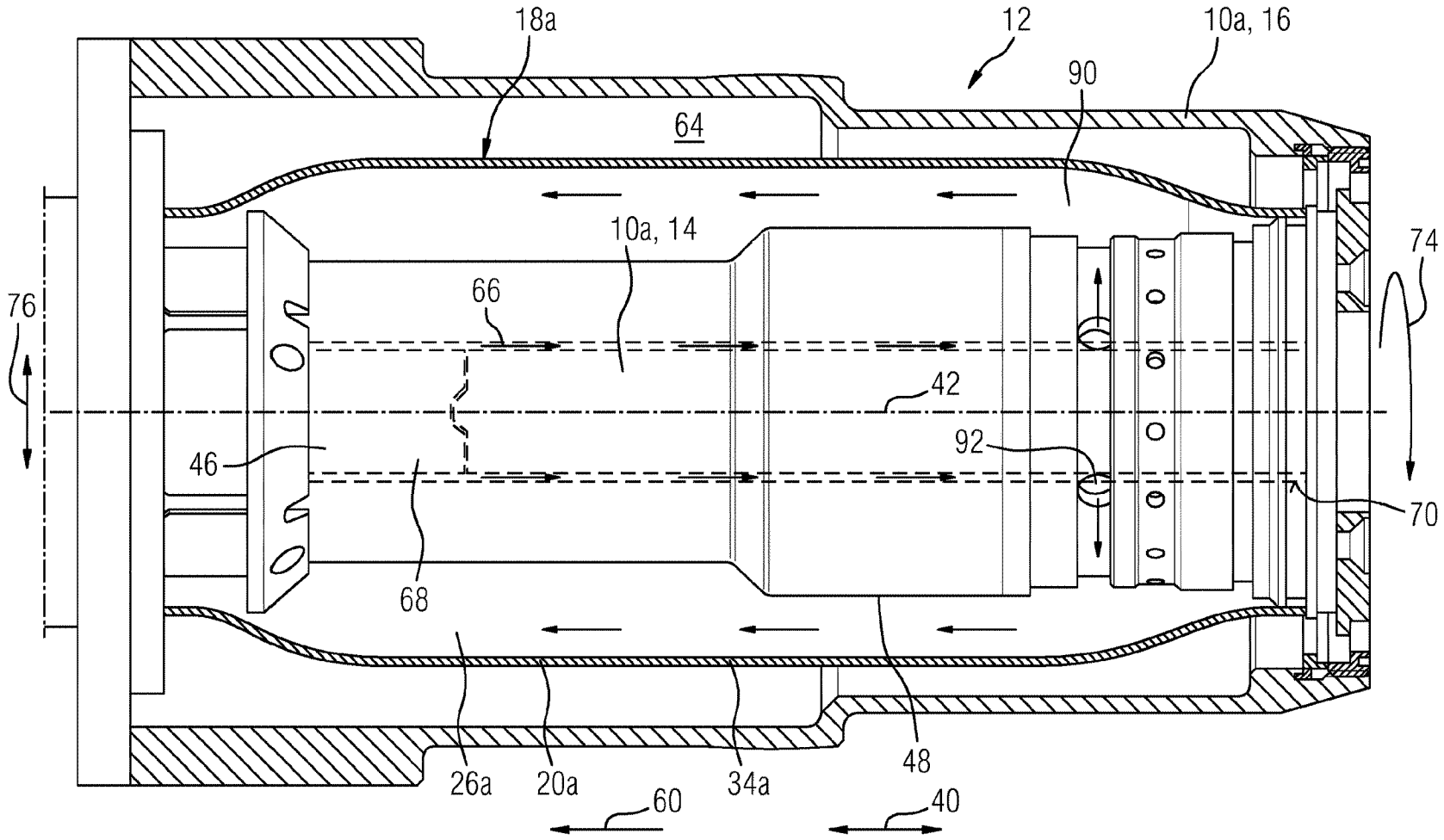
FIG. 7 shows schematically the female socket from FIG. 5 in the mated position.
Figure 8:
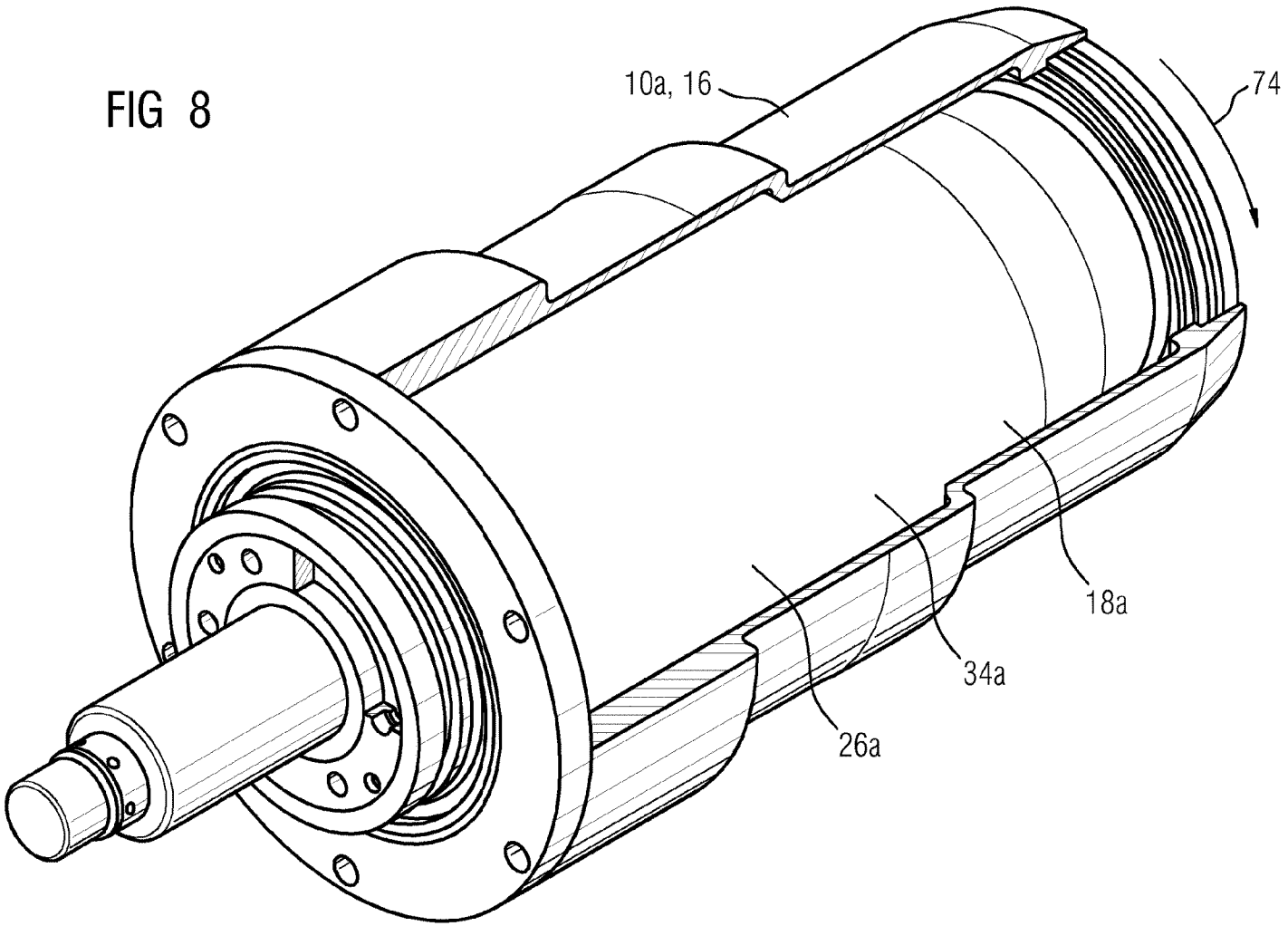
FIG. 8: shows a perspective view of the female socket from FIG. 7.

FIGS. 5 to 8 shows an alternative embodiment of the volume compensating arrangement 18. The volume compensating arrangement **18*a* of FIGS. 5 to 8 differs from the volume compensating arrangement 18 of FIGS. 1 to 4 in that it is embodied as a flexible bellows 34*a*. The volume compensating arrangement 18*a* comprises a first chamber 26*a* that is at least partially encased by a first flexible and thermoplastic layer 20*a* and a wall 48 of a receiving chamber 46 of the female part 16. Therefore, the first flexible layer 20*a* is arranged basically in parallel to an axis 42 of a connector part 10 or a female part 16, respectively. Hence, the first flexible layer 20*a* is a cylindrical diaphragm or a sleeve type diaphragm. FIGS. 5 and 6 show the female part 16 and the shape of the bellows 34*a* in the unmated state. In FIGS. 7 and 8 the female part 16 and the shape of the bellows 34*a*** is shown in the mated state.

A male pin 14 pushes a shuttle pin 68 of the female part 16 until a stop position is reached. A lubricant 66 present in the receiving chamber 46 must displace to a supply channel 90 outside of a socket contact 62 and goes into the first chamber **26*a*. Due to the flexibility of the first flexible layer 20*a* and in order to compensate for the increase in volume, the first chamber 26*a*** is going to deform.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

Although the invention is illustrated and described in detail by the preferred embodiments, the invention is not limited by the examples disclosed, and other variations can be derived therefrom by a person skilled in the art without departing from the scope of the invention.

The invention claimed is:

1. A connector part for a connector unit, the connector part comprising:

at least one volume compensating arrangement with at least a first flexible layer and at least a first chamber, wherein the at least first flexible layer at least partially encases the at least first chamber, wherein the at least first flexible layer comprises at least one thermoplastic material, wherein a surface of the at least first flexible layer that faces the at least first chamber comprises at least one coating.

2. The connector part according to claim 1, wherein the at least first flexible layer has a thickness of about 0.2 millimeter (mm) to 2 mm.

3. The connector part according to claim 1, wherein the at least first flexible layer is embodied as a thermoplastic diaphragm, and/or wherein the at least first flexible layer is embodied as a flexible bellows, and/or wherein the at least first flexible layer comprises at least two axially compressible sections arranged in axial direction of the connector part one after the other.

4. The connector part according to claim 1, wherein the at least first flexible layer is arranged basically perpendicular to an axis of the connector part.

5. The connector part according to claim 1, wherein the at least first flexible layer is arranged basically in parallel to an axis of the connector part.

6. The connector part according to claim 1, wherein the volume compensating arrangement comprises at least a second flexible layer, and/or wherein the at least second flexible layer partially encases the at least first chamber.

7. The connector part according to claim 1, wherein the volume compensating arrangement comprises at least one security volume that is arranged directly adjacent to the at least first flexible layer of the at least first chamber in a direction basically coaxially to an axis of the connector part.

8. The connector part according to claim 1, further comprising:

at least a receiving chamber, and/or at least two volume compensating arrangements, and/or wherein the at least two volume compensating arrangements are connected in parallel to the receiving chamber.

9. The connector part according to claim 1, further comprising:

at least a receiving chamber, and/or wherein the at least first flexible layer and a wall of the receiving chamber at least partially encase the first chamber, and/or wherein the at least first flexible layer comprises at least two compressible sections, wherein one compressible section and a wall of the receiving chamber at least partially encase the first chamber and/or the other compressible section and a wall of the receiving chamber at least partially encase an at least second chamber of the volume compensating arrangement.

10. The connector part according to claim 1, wherein the connector part is embodied as a male part and/or as a female part of the connector unit.

11. The connector part according to claim 1, wherein the at least first flexible layer has a thickness of about 0.75 mm to 1.25 mm.

12. The connector part according to claim 1, wherein the coating has a thickness of about 0.75 μm to 1.25 μm.

13. The connector part according to claim 1, wherein the coating has a thickness of about 0.2 micrometer (μm) to 2 μm.

14. The connector part according to claim 13, wherein the at least one coating comprises at least one corrosion resistant material.

15. The connector part according to claim 13, wherein the coating is applied by one of the following methods: Physical vapour deposition (PVD), coating, high velocity oxygen fuel spraying (HVOF) and plasma spraying.

16. The connector part according to claim 13, wherein the at least one coating comprises at least one metal.

17. The connector part according to claim 13, wherein the at least one coating comprises titanium.

18. The connector part according to claim 1, wherein the thermoplastic material is a Polytetrafluoroethylene (PTFE)-based material.

19. The connector part according to claim 18, wherein the thermoplastic material comprises Polychlorotrifluoroethylene (PCTFE).

20. A connector unit for use in a subsea environment, the connector unit including a connector part having a volume compensating arrangement comprising a flexible member at least partially defining a chamber for receiving a lubricant displaced when a male part of the connector unit is mated into a female part of the connector unit, the connector unit characterized by:

the flexible member comprising a thermoplastic material, and a coating applied on a chamber side of the thermoplastic material.

21. The connector unit of claim 20, further characterized by the thermoplastic material comprising a polytetrafluoroethylene (PTFE)-based material.

* * * * *